US005487267A

United States Patent [19]

Alquist et al.

[11] Patent Number: 5,487,267

[45] Date of Patent: Jan. 30, 1996

[54] SUPPRESSION OF INFRARED RADIATION EMISSIONS FROM JET ENGINES

[75] Inventors: Henry E. Alquist; Robert M. Schirmer, both of Bartlesville, Okla.

[73] Assignee: Phillips Petroleum Company, Bartlesville, Okla.

[21] Appl. No.: 216,024

[22] Filed: Jan. 7, 1972

[51] Int. Cl.[6] ..... C06D 5/06

[52] U.S. Cl. ..... 60/206; 60/207; 60/208; 60/209; 60/218; 60/219

[58] Field of Search ..... 60/206, 207, 208, 60/209, 215, 218, 219

[56] References Cited

U.S. PATENT DOCUMENTS 2,655,786 10/1953 Carr ..... 60/206
2,782,592 2/1957 Kolfenback ..... 60/209
3,086,355 4/1963 Mickel et al. ..... 60/206 X
3,486,338 12/1969 Haussmann et al. ..... 60/208 X

*Primary Examiner*—Donald P. Walsh
*Attorney, Agent, or Firm*—Richmond, Phillips, Hitchcock & Fish

[57] ABSTRACT

A reduction in the emission of infrared radiation by the engine of a jet aircraft can be achieved by employing a low molecular weight monohydric alcohol, having a luminometer number of at least about 200 as at least a portion of the fuel. Additional reduction in emission of infrared radiation can be achieved by passing a low molecular weight monohydric alcohol in indirect heat exchange relationship with the hot exhaust nozzle prior to its introduction to the combustion chamber of the engine.

8 Claims, 1 Drawing Sheet

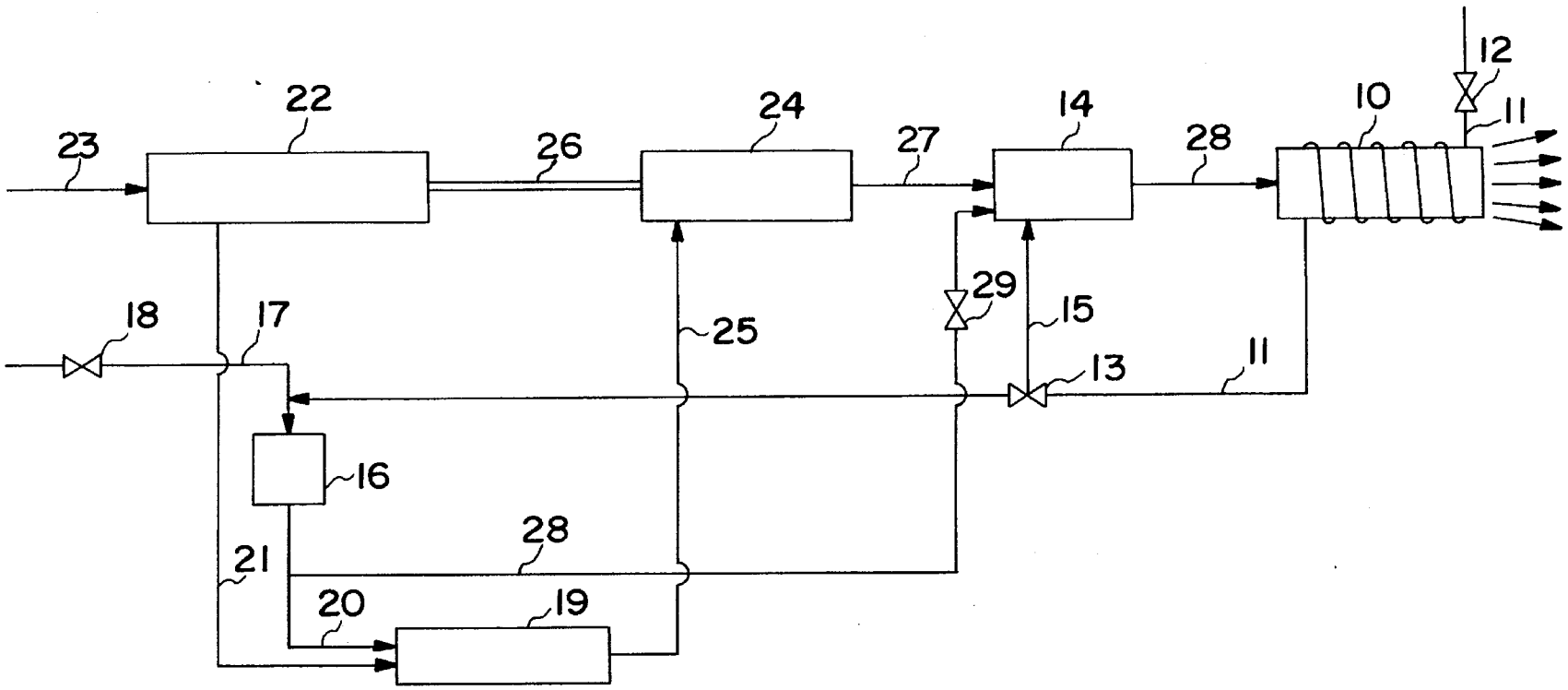
10
11
12
28
14
15
13
11
29
27
24
25
26
28
19
22
16
20
17
21
18
23

SUPPRESSION OF INFRARED RADIATION EMISSIONS FROM JET ENGINES

BACKGROUND OF THE INVENTION

This invention relates to a method for operating a jet engine. When operating over enemy territory, a military jet aircraft is likely to come under attack by enemy air-to-air and surface-to-air missiles. These missiles may have any one of a variety of systems designed to direct a missile to intercept the aircraft under attack. One highly effective system uses a heat sensing device that allows the missile to home-in on the aircraft by detecting infrared radiation emitted by the aircraft.

The infrared radiation given off by a jet aircraft is largely the product of the smoky exhaust and very hot exhaust nozzle. Military jet aircraft in normal operation burn a hydrocarbon fuel. Such fuels emit smoke from the exhaust nozzle. The smoke is composed of very hot particles of carbonaceous material. As the hot particles pass from the engine they transmit at least a portion of their heat to the exhaust nozzle causing its temperature to rise. Both the exhaust nozzle and the carbonaceous particles act like black body radiators to give off energy in the infrared spectrum.

SUMMARY OF THE INVENTION

It is an object of this invention to reduce the emission of infrared radiation from a jet engine.

It is a further object of this invention to reduce or eliminate the particulate carbonaceous material comprising the smoky exhaust of a jet aircraft.

It is yet another object of this invention to reduce the infrared radiation given off by the exhaust nozzle of a jet aircraft.

In accordance with this invention, there is provided a method of operating a jet engine that comprises employing a fuel that is comprised of a low molecular weight monohydric alcohol having up to 6 carbon atoms per molecule, preferably 1 to 4 carbon atoms per molecule, said alcohol having a luminometer number of at least about 200. If desired, the alcohol may be blended with the conventional hydrocarbon fuel so long as the luminometer number of the resulting blend is at least about 200.

Further in accordance with this invention, there is provided a method of reducing the infrared radiation of the exhaust nozzle comprising passing the low molecular weight monohydric alcohol fuel component in indirect heat exchange relationship with the exhaust nozzle. The low molecular weight monohydric alcohol is preferably in contact with a reforming catalyst during the heat exchange process. The reforming process is endothermic and, therefore, is able to absorb more thermal energy making the heat exchange process more efficient.

BRIEF DESCRIPTION OF THE DRAWING

The drawing is a diagrammatic illustration of the functional portions of a turbojet engine incorporating the novel features of this invention.

DESCRIPTION OF THE PREFERRED EMBODIMENTS

The infrared radiation emitted by a turbojet engine is largely due to the smoke present in the exhaust. This smoke is made up of very hot carbonaceous particles. These particles emit infrared radiation and transmit at least a portion of their heat content to the metallic portion of the exhaust nozzle before they are exhausted to the atmosphere. The hot exhaust nozzle itself gives off additional infrared radiation emissions.

In the practice of this invention, a reduction in infrared radiation emitted by a turbojet engine can be achieved by employing as the fuel for the engine and/or afterburner a composition comprising a low molecular weight monohydric alcohol wherein the fuel has a luminometer number of at least about 200. Fuels having a luminometer number above about 200 burn essentially smoke free. This elimination of the smoky portion of the exhaust removes a major contributor to the infrared radiation emitted by the jet engine.

Luminometer number is a measure of how much radiant heat a fuel gives off during burning and is related inversely to flame luminosity. In other words, a fuel having a high luminometer number burns with low luminosity. The luminosity of very luminous flames is caused by the incandescence of carbonaceous particles making up the smoky portion of the flame. In the case of jet aircraft, these particles result from incomplete combustion in the engine or afterburner at that point of the flame front where insufficient oxygen is present to insure complete combustion. These particles are, of course, very hot and emit infrared radiation.

Conventional jet fuels are usually a hydrocarbon blend derived from the kerosene portion of refinery processed crude oil. These fuels have a luminometer number that ranges from about 45–50. These fuels are satisfactory for most purposes and have the economic advantage of being relatively inexpensive. However, the smoky particles they can emit can attract a heat-seeking missile.

The low molecular weight monohydric alcohol comprising the fuel of this invention can be used alone or as a blend with the conventional fuel. Therefore, to be suitable the low molecular weight monohydric alcohol must have a luminometer number of at least about 200. If it is desired to blend the alcohol with the conventional fuel to prepare the fuel of this invention, it will normally be required that the actual alcohol employed have a luminometer number greater than 200.

Low molecular weight monohydric alcohols suitable for use in this invention include the following:

| Alcohol | Luminometer Number |
|---|---|
| Methyl alcohol | 800 |
| Ethyl alcohol | 655 |
| N-propyl alcohol | 480 |
| Isopropyl alcohol | 300 |
| N-butyl alcohol | 400 |
| Isobutyl alcohol | 310 |
| Secondary butyl alcohol | 320 |

In order to achieve maximum suppression of infrared radiation emitted by the engine, it is preferred to use methyl alcohol or ethyl alcohol. Methyl alcohol is most preferred.

In order to avoid carrying large amounts of the alcohol fuel, the aircraft engine would be operated on conventional fuel except in those situations where attack by heat-seeking missiles would be expected. At that time, the aircraft can switch to the alcohol fuel. However, in order to achieve a longer period of operation with reduced infrared emission, it is preferred to employ a mixture of conventional fuel and low molecular weight monohydric alcohol. When a blend of low molecular weight monohydric alcohol and conventional fuel is employed, it is preferred that the resulting fuel combination have a luminometer number from about 400–600.

In a preferred embodiment of this invention, the low molecular weight monohydric alcohol can be passed in indirect heat exchange relationship with the exhaust nozzle before introduction into the combustion chamber of the turbojet engine. This has the desirable effect of reducing exhaust nozzle temperature and therefore the infrared radiation emissions from the nozzle while raising the temperature of the fuel.

During the heat exchange process, it is preferred to have the low molecular weight monohydric alcohol in contact with a reforming catalyst for the purpose of converting at least a portion of the alcohol to carbon monoxide and hydrogen. This reaction is endothermic and therefore heat absorbing and would cause the heat exchange process to be a more efficient one.

Energy absorbed during the reforming would compensate for the low heat of combustion of the low molecular weight monohydric alcohol relative to the usual hydrocarbon fuel. In addition, the hydrogen and carbon monoxide formed in the reforming process will impart superior combustion characteristics to the afterburner flame plume thereby further reducing plume size and temperature. This would have the effect of reducing infrared radiation emissions. Suitable catalysts for reforming alcohols that can be employed in this invention are those catalysts which have activity for the steam reforming of hydrocarbons. These include, but are not limited to, the following: Nickel on calcium aluminate, nickel on alumina, ruthenium on alumina, barium and nickel on calcium aluminate, nickel on kieselguhr, potassium and nickel on alumina, barium on calcium aluminate, cobalt on alumina, and the like, and mixtures thereof.

Referring now to the drawing, which diagrammatically represents a preferred embodiment of this invention, the components of a conventional jet engine are shown schematically. The alcohol fuel from a source not shown is passed in heat exchange relationship with exhaust nozzle 10 through alcohol feed line 11. The alcohol fuel is metered into line 11 through valve 12 or other flow regulating means.

The portion of line 11 disposed so as to function as a means for absorbing heat from the nozzle 10, preferably contains a reforming catalyst. The alcohol feed as it passes in heat exchange relationship with the hot exhaust nozzle is at least partially reformed to carbon monoxide and hydrogen. A portion of the partially reformed alcohol can be metered through valve 13 or other means into afterburner 14 through line 15. The remainder of the partially reformed alcohol can be metered to the suction side of fuel pump 16 through line 17. Under normal operating conditions, conventional fuel from a source not shown can be metered through valve 18 or other means to the suction side of fuel pump 16 through line 17. Under conditions when it is desired to avoid attack by heat-seeking missiles, the conventional fuel may be switched off or blended with the alcohol fuel to achieve the desired luminometer number.

As shown in the drawing, it is preferred to mix the conventional fuel with the partially reformed alcohol on the suction side of the fuel pump to avoid the problem of fuel immiscibility. The conventional fuel, partially reformed alcohol, or mixture thereof is conducted from the fuel pump 16 to the combustion chamber 19 through line 20 and/or to the afterburner 14 through line 28 and conventional metering valve 29. In the combustion chamber, the fuel is combined with compressed air introduced through line 21 from compressor 22. The inlet for air to the compressor is indicated by means of line 23. The combined air and fuel, which may be the conventional fuel, partially reformed alcohol or mixture thereof, are burned and the products of combustion are conducted to turbine 24 through line 25. The combustion gases drive turbine 24 which by means of shaft 26 drives compressor 22. The gases are then conducted through conduit 27 to afterburner 14 where they can be blended with conventional fuel, partially reformed alcohol or mixture thereof delivered through line 28 and burned. Alternatively, or in addition, said gases can be blended with a portion of the partially reformed alcohol delivered through line 15 and burned. The resulting gases are then conducted to exhaust nozzle 10 through tail pipe section 28 and are vented to the atmosphere.

The foregoing procedure, employing the apparatus described, takes place when the aircraft is flying under conditions where it is anticipated that attack from heat-seeking missiles is likely, i.e., over enemy territory or when confronted by hostile aircraft carrying such missiles.

Under normal operating conditions, only conventional fuel would be employed. This minimizes the need for carrying large quantities of the low molecular weight monohydric alcohol which delivers less horsepower per unit weight than does the conventional hydrocarbon fuel.

We claim:

1. In the operation of a turbojet engine, a method of suppressing infrared radiation comprising introducing into said engine a fuel mixture of a low molecular weight monohydric alcohol and conventional hydrocarbon fuel in proportion so the luminometer number of the blend is in the range of about 200 to about 600.

2. A method according to claim 1 wherein the low molecular weight monohydric alcohol has a luminometer number of at least about 200.

3. A method according to claim 1 wherein the alcohol is selected from the group consisting of methyl alcohol, ethyl alcohol, N-propyl alcohol, isopropyl alcohol, N-butyl alcohol, isobutyl alcohol and secondary butyl alcohol.

4. A method according to claim 1 wherein the low molecular weight monohydric alcohol is passed in indirect heat exchange relationship with the turbojet engine exhaust nozzle prior to introduction into the engine.

5. A method according to claim 4 wherein the low molecular weight monohydric alcohol is contacted with a reforming catalyst during the indirect heat exchange.

6. A method according to claim 5 wherein the reforming catalyst is at least one catalyst selected from the group consisting of nickel on calcium aluminate, nickel on alumina, ruthenium on alumina, barium and nickel on calcium aluminate, nickel on kieselguhr, potassium and nickel on alumina, barium on calcium aluminate, or cobalt on alumina and the alcohol is methyl alcohol.

7. A method according to claim 1 wherein the low molecular weight monohydric alcohol and the conventional hydrocarbon fuel are blended on the suction side of the engine fuel pump.

8. A method according to claim 5 wherein the low molecular weight monohydric alcohol after partial reforming is blended with the conventional hydrocarbon fuel in proportion so that the luminometer number of the blend is within the range of about 200 to about 600.

* * * * *